US007987927B2

(12) United States Patent
Downton

(10) Patent No.: US 7,987,927 B2
(45) Date of Patent: Aug. 2, 2011

(54) STEERING OF BENT HOUSING MUD MOTOR DOWNHOLE ROTATION DEVICE

(75) Inventor: Geoff Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 551 days.

(21) Appl. No.: 11/567,833

(22) Filed: Dec. 7, 2006

(65) Prior Publication Data

US 2007/0151767 A1 Jul. 5, 2007

(30) Foreign Application Priority Data

Dec. 8, 2005 (GB) ..... 0524998.2

(51) Int. Cl.
*E21B 7/04* (2006.01)

(52) U.S. Cl. ..... 175/61; 175/73; 175/27

(58) Field of Classification Search ..... 175/57, 175/61, 73, 27
See application file for complete search history.

(56) References Cited

U.S. PATENT DOCUMENTS

| | | | | |
|---|---|---|---|---|
| 1,892,217 | A | 12/1932 | Moineau | |
| 3,084,631 | A | 4/1963 | Bourke | |
| 5,343,956 | A * | 9/1994 | Coronado | 166/387 |
| 5,778,992 | A * | 7/1998 | Fuller | 175/73 |
| 6,047,784 | A * | 4/2000 | Dorel | 175/61 |
| 6,092,610 | A * | 7/2000 | Kosmala et al. | 175/61 |
| 6,543,132 | B1 | 4/2003 | Krueger et al. | |
| 6,568,076 | B2 | 5/2003 | Bottos et al. | |
| 6,601,658 | B1 * | 8/2003 | Downton | 175/45 |

FOREIGN PATENT DOCUMENTS

WO W02004036043 4/2004

* cited by examiner

*Primary Examiner* — Daniel P Stephenson
*Assistant Examiner* — Yong-Suk Ro
(74) *Attorney, Agent, or Firm* — Jeremy Welch; Jeff Griffin

(57) ABSTRACT

A steerable drilling system includes a drill string carrying a bent housing, the bent housing containing or having associated therewith a drive motor arranged to drive a drive shaft angled to an axis of part of the drill string adjacent the bent housing, and an orientating motor permitting relative rotation between the drill string and the bent housing, the orientating motor driving the output shaft in a reverse direction relative to a direction of rotation of the drill string to form a curve in a borehole being formed.

21 Claims, 3 Drawing Sheets

STEERING OF BENT HOUSING MUD MOTOR DOWNHOLE ROTATION DEVICE

RELATED APPLICATION DATA

This application claims priority from GB Application Number 0524998.2 filed on Dec. 8, 2005.

FIELD OF THE INVENTION

This invention relates to a steerable drilling system for use in the formation of a borehole, for example for subsequent use in the extraction of hydrocarbons. It also relates to a control arrangement suitable for use therein.

BACKGROUND TO THE INVENTION

In one known form of steerable drilling system, a motor is connected to and carried by a drill string, the motor being designed such that an output shaft thereof is angled to the axis of the associated end part of the drill string. A drill bit is connected to the motor so as to be driven for rotation thereby.

Progressive cavity pumps or motors, also referred to as a progressing cavity pumps or motors, typically include a power section consisting of a rotor with a profiled helical outer surface disposed within a stator with a profiled helical inner surface. The rotor and stator of a progressive cavity apparatus operate according to the Moineau principle, originally disclosed in U.S. Pat. No. 1,892,217.

In use as a pump, relative rotation is provided between the stator and rotor by any means known in the art, and a portion of the profiled helical outer surface of the rotor engages the profiled helical inner surface of the stator to form a sealed chamber or cavity. As the rotor turns eccentrically within the stator, the cavity progresses axially to move any fluid present in the cavity.

In use as a motor, a fluid source is provided to the cavities formed between the rotor and stator. The pressure of the fluid causes the cavity to progress and a relative rotation between the stator and rotor. In this manner fluidic energy can be converted into mechanical energy.

As progressive cavity pumps or motors rely on a seal between the stator and rotor surfaces, one of or both of these surfaces preferably includes a resilient or dimensionally forgiving material. Typically, the resilient material has been a relatively thin layer of elastomer disposed in the interior surface of the stator. A stator with a thin elastomeric layer is typically referred to as thin wall or even wall design.

An elastomeric lined stator with a uniform or even thickness elastomeric layer has previously been disclosed in U.S. Pat. No. 3,084,631 on "Helical Gear Pump with Stator Compression". The prior art has evolved around the principle of injecting an elastomer into a relatively narrow void between a stator body with a profiled helical bore and a core, or mandrel, with a profiled helical outer surface. The core is then removed after curing of the elastomer and the remaining assembly forms the elastomeric lined stator. The elastomer layer is essentially the last component formed.

The stator bodies mentioned above have a pre-formed profiled helical bore. The profiled helical bore is generally manufactured by methods such as rolling, swaging, or spray forming, as described in U.S. Pat. No. 6,543,132 on "Methods of Making Mud Motors", incorporated by reference herein. Similarly, a profiled helical bore can be formed by metal extrusion, as described in U.S. Pat. No. 6,568,076 on "Internally Profiled Stator Tube", incorporated by reference herein. Further, various hot or cold metal forming techniques, such as pilgering, flow forming, or hydraulic forming, as described in P.C.T. Pub. No. WO 2004/036043 A1 on "Stators of a Moineau-Pump", incorporated by reference herein, can be used to form a stator body with a profiled helical bore.

A stator body can also be formed by creating a profited helical bore in relatively thin metal tubing. This formed metal tube can then be used as the stator body by itself, with an injected inner elastomeric layer, or the formed metal tube can be inserted inside into a second body with a longitudinal bore to form the stator body. A stator body with a profiled helical bore can also be formed through other process such as sintering or hot isostatic pressing of powdered materials, for example, a metal, or the profiled helical bore can be machined directly into a body.

In use, the motor is driven to rotate the bit, and a load is applied to the bit. As a result, the bit scrapes, abrades or gouges material from the formation being drilled. Where it is required to drill straight ahead, the drill string is rotated so that the direction in which the drill bit is pointed constantly changes, precessing around the desired drilling direction. To form a curve in the borehole, rotation of the drill string is halted with the motor orientated such that the drill bit tool face is directed in the desired direction.

Stopping rotation of the drill bit in this manner is undesirable as there is the risk of differential sticking, particularly in depleted zones. Further, continued drilling with the drill string non-rotating requires the drill string to slide within the borehole, reducing the weight-on-bit load which can be applied to the bit and thus slowing drilling.

Further disadvantages with this type of system are that stopping the drill string with the bit pointing in the desired direction is difficult, and that once this has been achieved, operation of the motor results in the application of a reactive force which can result in the motor shifting to an angular position in which the bit is no longer pointing in the desired direction. Time must then be spent adjusting the angular position of the drill string to move the motor back to the desired orientation.

It is an object of the invention to provide a drilling system in which these disadvantages are of reduced effect.

SUMMARY OF INVENTION

According to the present invention there is provided a steerable drilling system comprising a drill string carrying a bent housing, the bent housing containing or having associated therewith a motor arranged to drive a drive shaft angled to an axis of part of the drill string adjacent the bent housing, and means permitting relative rotation between the drill string and the bent housing.

The means permitting relative rotation could comprise, for example, an orientating motor carried by either the drill string or the bent housing, the orientating motor having a drive shaft connected to the other of the drill string and the bent housing. By operating the orientating motor to drive the bent housing relative to the drill string at the same speed of rotation as the drill string but in the reverse direction, the bent housing can be held against rotation in a desired orientation whilst rotation of the drill string continues. Another possibility is for the orientating motor to be located in a separate housing located between the drill string and the bent housing.

Alternatively, a releasable latch arrangement may be provided so as to allow the drill string to rotate, the orientating motor having anchors associated therewith to allow it to be anchored against rotation and to be operable to drive the bent housing to the desired orientation. A further possibility is to omit the orientating motor, instead using the rotation of the drill string to orientate the bent housing, and using an anchor arrangement to resist rotation of the bent housing when the desired orientation is achieved, a latch being released to allow rotation of the drill string to continue.

Where an orientating motor is provided, the motor may comprise a mud or drilling fluid driven motor, for example a Moineau motor, and a control valve arrangement may be provided to control the supply of fluid to the motor. The control valve arrangement may control the supply of fluid to both ends of the motor and thereby control its direction of rotation. The control valve arrangement may comprise a rotary valve including one plate component rotatable with the rotor of the motor, and another plate component the angular position of which is controlled by a control unit, for example by connecting the said component to a roll stabilised platform. Alternatively, the valve arrangement may comprise, for example, a pair of bistable valves, each controlling the supply of fluid to a respective end of the motor.

The invention also relates to a control arrangement comprising a motor including a rotor, and a control valve arrangement controlling the supply of fluid to the motor. The control valve arrangement may be of the form described above.

BRIEF DESCRIPTION OF THE DRAWINGS

The invention will further be described, by way of example, with reference to the accompanying drawings, in which.

DETAILED DESCRIPTION OF PREFERRED EMBODIMENTS

Figure 1:
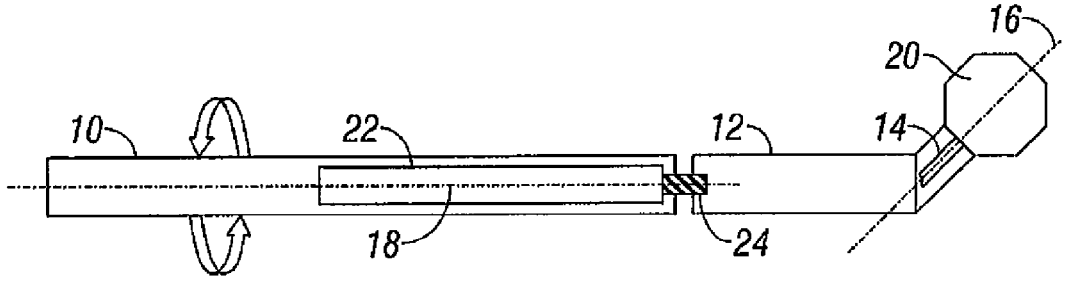
FIGS. 1 to 4 are diagrammatic illustrations of drilling systems in accordance with embodiments of the invention.

The steerable drilling system illustrated, diagrammatically, in FIG. 1 comprises a drill string 10 and a bent housing 12. The bent housing 12 contains a motor, for example a drilling fluid operated motor arranged to drive a drive shaft 14 for rotation about an axis 16 angled relative to the axis 18 of the end part of the drill string 10. A drill bit 20 is connected to the drive shaft of the motor such that operation of the motor causes rotation of the drill bit 20.

An orientating motor 22 is carried by the end of the drill string 10 adjacent the bent housing 12, the orientating motor 22 having an output shaft 24 connected to the bent housing 12 such that the orientating motor 22 controls the angular position of the bent housing 12 relative to the drill string 10.

In use, the drill string 10 is rotated in a conventional manner and a load is applied thereto to apply a weight-on-bit load to the bit 20. The bit drive motor located within the bent housing 12 is operated to rotate the drive shaft 14, and hence bit 20, for rotation about the axis 16. The combination of the applied weight-on-bit load and the rotation of the bit 20 causes the bit to gouge, abrade or scrape material away from the formation in which the borehole is being formed. The material removed in this manner is carried away from the bit by drilling fluid in the conventional manner.

When it is desired to steer the steerable system so as to form a curve in the borehole being formed, the orientating motor 22 is operated to drive the drive shaft 24 thereof in the reverse direction relative to the direction of rotation of the drill string, but at the same speed thereas, with the result that the bent housing 12 remains non-rotating in space whilst rotation of the drill string 10 continues as normal. The operation of the orientating motor 22 is such that the bent housing 12 is held non-rotating in space with the axis 16 directed such that the bit tool face is at the desired angle. The application of the weight-on-bit load and rotation of the bit 20 continue with the result that the borehole extends in the desired direction. Slight increases or decreases in the operating speed of the orientating motor 22 can be used to achieve small adjustments to the drilling direction, for example to correct for the motor 22 moving away from its desired position.

If it is desired to extend the borehole substantially straight ahead, then the orientating motor 22 is switched off with the result that the bent housing 12 rotates with the drill string 10. Consequently, the direction in which the drill bit 20 is pointed continuously changes, precessing around the desired drilling direction, with. the net result that the borehole is extended substantially straight ahead as desired.

It will be appreciated that although, in FIG. 1, the orientating motor 22 is carried by the drill string 10, the orientating motor 22 could alternatively be located within the bent housing 12, the output shaft 24 of the orientating motor 22 being connected to the drill string 10.

Both of these arrangements have the advantage that the drill string 10 can be rotated continuously in both of the described drilling modes.

Figure 2:
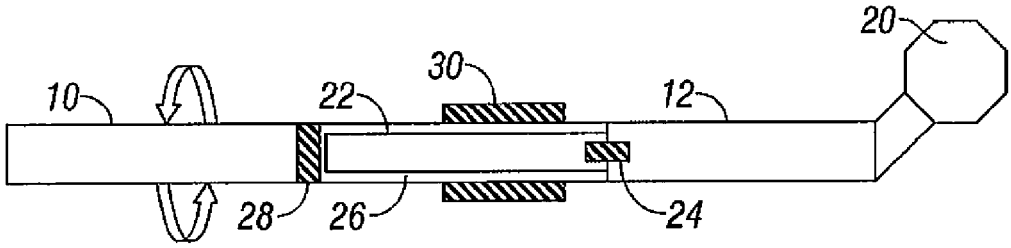

FIG. 2 illustrates an arrangement similar to that illustrated in FIG. 1 but in which the orientating motor 22 is located within its own motor housing 26, a releasable latch arrangement 28 being provided between the housing 26 of the orientating motor 22 and the drill string 10, and an anchor arrangement 30 being provided to allow the housing 26 to become anchored against angular movement relative to the formation in which the borehole is being formed. In use, when drilling straight ahead, the latch arrangement 28 is operated to drive the housing 26 for rotation with the drill string 10, and the anchor arrangement 30 is de-activated. In this mode of operation, the arrangement operates in a manner very similar to that of FIG. 1 when drilling straight ahead.

When it is desired to form a curve in the borehole, the latch arrangement 28 is disengaged to allow the drill string 10 to continue to rotate whilst the housing 26 is held against rotation by the anchor arrangement 30. Once anchored against rotation by the anchor arrangement 30, the orientating motor 22 is driven to rotate the bent housing 12 to the desired orientation and to hold the bent housing 12 in that orientation. Operation of the bit drive motor to drive the drive shaft 14 in combination with the application of a weight-on-bit load from the drill string 10 causes the borehole to be extended in the desired direction.

It will be appreciated that if, during the operation of the motor, slight angular movement of the bent housing 12 occurs so that the bit 20 is no longer pointed in the desired orientation, operation of the orientating motor 22 can be used to return the bent housing 12 to the desired orientation.

Figure 3:
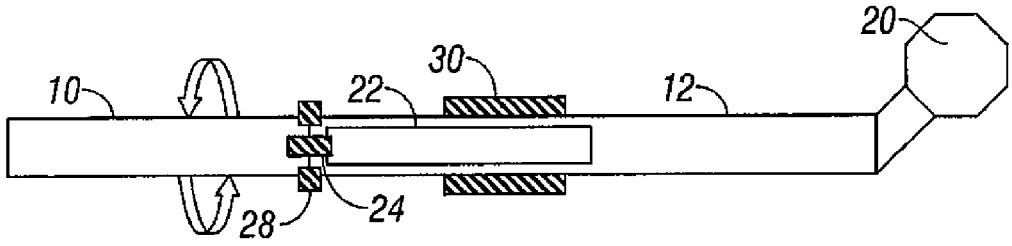

FIG. 3 illustrates an arrangement in which the orientating motor 22 is located within the bent housing 12, the output shaft 24 of the orientating motor 22 being connected to the drill string. A latch arrangement 28 is also provided between the bent housing 12 and the drill string 10 and an anchoring arrangement 30 is provided to hold the bent housing 12 against rotation relative to the formation in which the borehole is being formed, when desired.

In this arrangement, when straight ahead drilling is required, the latch arrangement 28 is engaged and the anchor arrangement 30 disengaged with the result that the bent housing 12 rotates with the drill string 10. The tool face direction in which the bit 20 is pointing thus continuously changes, and rotation of the drill bit 20 by the bit drive motor located within the bent housing 12 in combination with the weight-on-bit load applied thereto results in the borehole being extended in a generally forward direction.

When it is desired to form a curve or dog-leg in the borehole being drilled, the drill string 10 is stopped, temporarily, and the latch arrangement 28 disengaged. The orientating motor 22 is then driven to adjust the orientation of the bent housing 12 relative to the drill string 10 until it is determined that the desired tool face direction has been attained. Once the desired angular position has been reached, the anchor arrangement 30 is engaged to hold the bent housing 12 in this orientation. The latch arrangement 28 remains disengaged and rotation of the drill string 10 can recommence with the bent housing 12 being held in the desired angular orientation by means of the anchor arrangement 30. It will be appreciated that the continued application of the weight-on-bit load in combination with the rotation of the drill bit 20 causes the borehole to be extended in the desired direction.

In this arrangement, in the event that angular movement of the bent housing 12 occurs, for example due to the reactive torque of the drill bit drive motor, then rotation of the drill string 10 will need to stop and the orientating motor 22 operated to move the bent housing 12 back to the desired orientation. Clearly, the effectiveness of the anchor arrangement 30 is of great significance, in this arrangement, to the efficiency with which the system can operate.

In any of the arrangements described hereinbefore in which an orientating motor 22 is provided, for example in the form of a downhole drilling fluid or mud powered motor, although the output of the motor may, in some circumstances, be used directly to control the orientation of the bent housing relative to the drill string, the invention also encompasses arrangements in which a gear box or other transmission system is incorporated.

Figure 4:
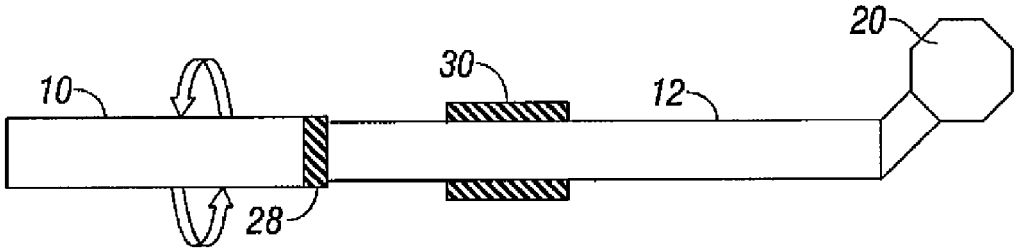

FIG. 4 illustrates an arrangement which, in some senses, is similar to that of FIG. 3, but in which the orientating motor 22 and associated output shaft 24 is omitted. In this arrangement, when drilling straight ahead, the latch arrangement 28 is engaged to drive the bent housing 12 for rotation with the drill string 10. When drilling in a desired direction is required, the drill string 10 is stopped with the bent housing 12 orientated such that the desired tool face direction is achieved. Once the desired orientation of the bent housing 12 has been achieved, the anchor arrangement 30 is engaged and the latch arrangement 28 disengaged such that rotation of the drill string 10 can recommence with the bent housing 12 held by the anchor arrangement 30 in the desired orientation. It will be appreciated that continuation of the rotation of the bit 20 in combination with the application of the weight-on-bit load causes drilling to recommence in the desired direction.

In this arrangement, in the event that the bent housing 12 moves out of its desired angular orientation, then the anchor 30 will need to be disengaged and the latch arrangement 28 re-engaged, and the drill string 10 rotated to return the bent housing 12 to the desired angular orientation at which point the anchor 30 can be re-engaged and the latch arrangement 28 disengaged and drilling continue.

Figure 5:
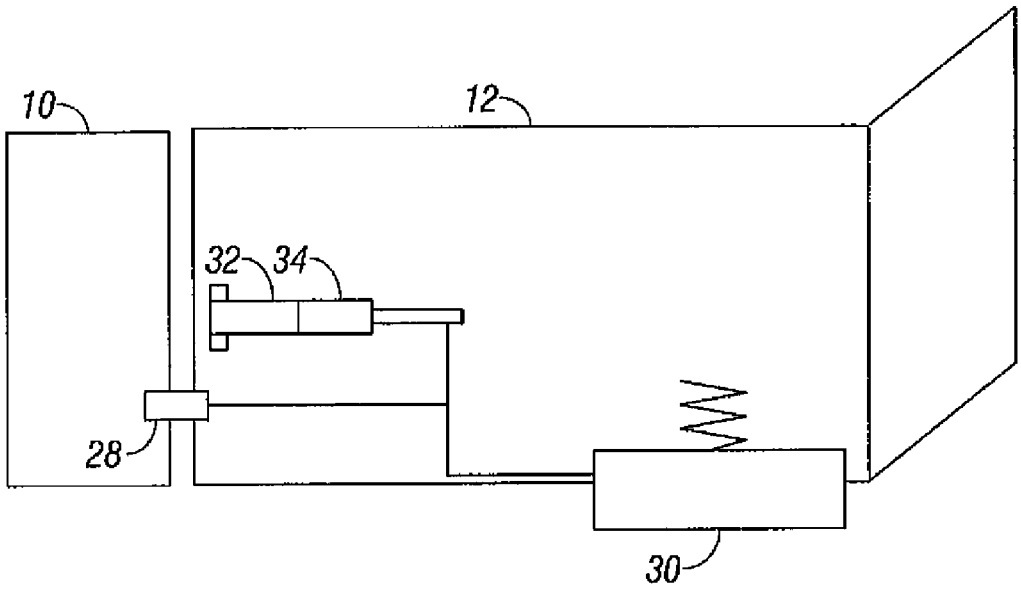
FIG. 5 is a diagram illustrating part of the system of FIG. 4.

FIG. 5 illustrates, diagrammatically, the operation of the arrangement illustrated in FIG. 4, the system requiring that at any time that the anchor arrangement 30 is engaged, the latch arrangement 28 must be disengaged, and that when the latch arrangement 28 is engaged, the anchor arrangement 30 must be disengaged. A turbine 32 is used to generate the electrical supply to operate the system, using the flow of drilling fluid, a control arrangement 34 being provided which makes use of sensors, for example indicative of the current tool face measurements, and other inputs, to determine how the latch arrangement 28 and anchor arrangement 30 should be operated at any given time.

In any of the arrangements described hereinbefore incorporating an orientating motor 22, the motor could take the form of a DC or AC operated electrical motor and associated gear box, a drilling fluid or mud operated motor arrangement, a turbine gear box and associated brake arrangement a pendulous weight controlling a rotary valve, or a bistable actuator used to port mud into a relatively small drilling fluid or mud operated motor. However, it will be appreciated that other types of motor could also be used. Control over the operation of the arrangement requires input signals representative of current tool face direction and this information could be derived from a tool face measurement system provided in the bent housing 12, or in the orientating motor 22 itself, means to allow sensing of the relative position between the orientating motor 22 and bent housing 12 being provided where appropriate, or in the drill string 10, means being provided to allow sensing of the position of the bent housing 12 relative to the drill string 10.

In addition to requiring information representative of the current tool face direction, a data transmission system may be required to transmit data representative of the desired drilling direction to the downhole located instrumentation and/or to transmit signals in the reverse direction. This information could be transmitted by appropriate modulation of the rate at which drilling fluid is supplied. Alternatively, it may be possible to transmit this information in the drill string by varying the speed of rotation thereof or by varying the pressure at which drilling fluid is supplied and using appropriate pressure sensors. The transmission of signals to the surface could be achieved using a measurement while drilling pulse arrangement or other mud pulse telemetry system.

Obviously, if electrical or electronic components are used downhole, then a suitable power source must be provided. This could take the form of a battery or other charge storage device. Alternatively, a turbine and associated alternator could be provided to generate electricity from the supply of drilling fluid (as described hereinbefore). A further possibility is to provide a deformable piezo-electric device to generate electricity.

The releasable latch arrangements 28 described hereinbefore could take a wide range of forms. For example they could take the form of two engageable friction surfaces. Alternatively, electro dynamic braking of a servo motor could be used to provide the latching force. A further possibility is to use hydraulic locking of a PDM servo motor or an oil displacement coupling to provide the latching force. Another possibility is to use a magneto rheological fluid in combination with an appropriate control arrangement for this purpose.

The anchor arrangements 30 mentioned hereinbefore could also take a wide range of forms. For example relative rotation of the drill string 10 and housing 26 or bent housing 12 could be used to drive anchor ribs radially outwardly until they engage the formation in which the borehole is being formed. Preferably, such movement would be by means of a hydraulic drive. Alternatively, bit pressure activated pistons may be driven out to engage the formation material. In use it will be appreciated that some axial movement of the bent unit will occur as drilling progresses. The anchors conveniently accommodate such movement by slipping, axially, within the borehole. Although axial slipping can be used to accommodate such movement, it will be appreciated that the anchors must still resist angular movement of the bent housing so that no appreciable rotation thereof occurs. It will be appreciated that a wide range of other modifications and alterations are possible.

Figure 6:
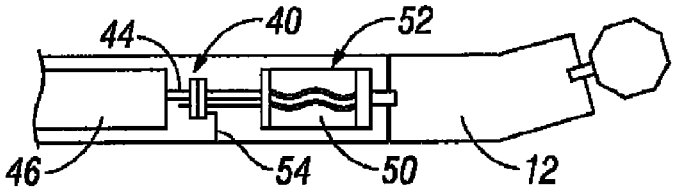
FIGS. 6 and 7*a* illustrate a control arrangement and associated drilling system.
Figure 7A:
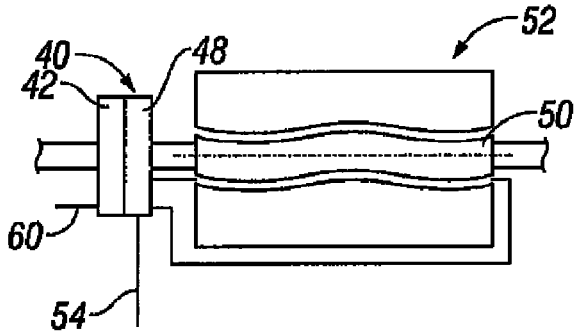

In arrangements including a drilling fluid or mud powered motor, for example of the general type illustrated in FIGS. 1 to 3, operation of the motor may be controlled using a control valve arrangement, FIGS. 6 and 7 shows a valve 40 comprising a first valve plate 42 mounted upon a rotatable shaft 44 connected to a control unit 46, and a second valve plate 48 connected to the rotor 50 of a motor 52. The rotor 50 is connected to a bent housing 12 as described hereinbefore. The first and second valve plates 42, 48 each include openings and are arranged such that, when the angular positions of the plates 42, 48 are such that the openings overlie one another, fluid is supplied from a high pressure inlet line 60 to the motor 52 to operate the motor 52, the fluid subsequently flowing to a choked, low pressure line 54. When the openings do not overlie one another, fluid is not supplied to the motor 52 and so the motor 52 does not operate.

In use, the control unit 46 holds the shaft 44 and first plate 42 in a desired geostationary angular position. If, in this position, the openings overlie one another, then the motor 52 will operate, the rotor 50 rotating until it reaches an angular position in which the openings no longer overlie one another. At this point, the motor 52 will stop. Should the motor be moved out of this desired position, for example by being dragged by the drill collar whilst the drill string continues to rotate, and the openings become aligned, then the motor will recommence operation to return to the desired position.

The valve may simply control the supply of fluid to one end of the motor, thus controlling whether the motor is operative and rotating in a first direction, or inoperative, relying upon friction and dragging to achieve reverse rotation. Alternatively, the valve may be operable to port fluid to either end of the motor to control the rotary direction of the motor.

The control unit may comprise a roll stabilised platform and associated sensors and controls.

It will be appreciated that, in all modes of operation, fluid will also flow past the orientating motor 50 to serve as a supply of fluid for the motor used to drive the drill bit and, typically, the drive motor for the drill bit will be significantly larger than the orientating motor.

Figure 7B:
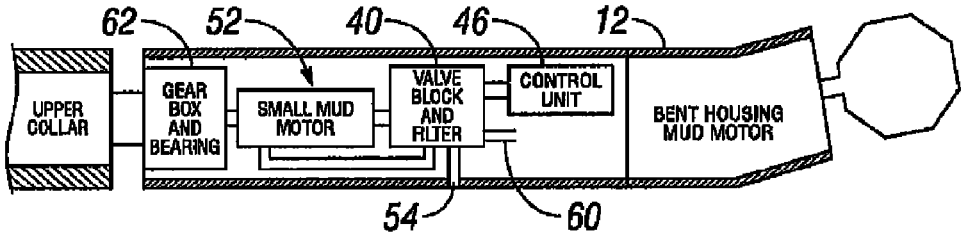
FIG. 7*b* illustrates a configuration similar to that of FIGS. 6 and 7*a*.

FIG. 7*b* illustrates a configuration similar to that of FIGS. 6 and 7 but in which the orientating motor 50 and associated control valve 40 and control unit 46, and an output gear box 62, are located in or associated with the bent housing 12.

This type of arrangement may be used, with appropriate modifications, in any of the motorised arrangements described hereinbefore.

Figure 8:
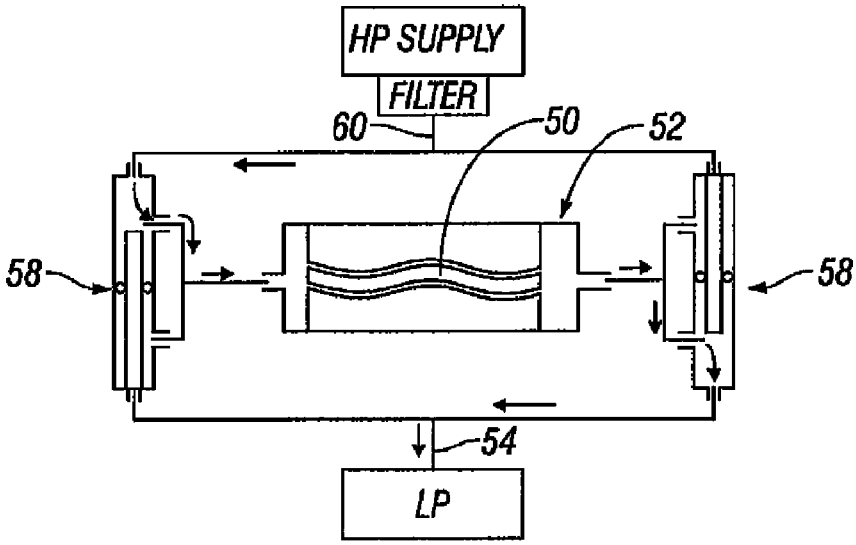
FIG. 8 illustrates an alternative control arrangement.

FIG. 8 illustrates an arrangement in which, rather than use a rotary valve to control operation of the motor, a pair of valves 58 are used, one valve 58 controlling the supply of fluid to one end of the motor 52, the other valve 58 controlling the supply of fluid to the opposite end of the motor 52. The valves 58 may be controlled such that one is open and the other closed, thereby causing the motor 52 to operate, the direction of rotation being controlled by appropriate selection of which of the valves 58 is open. Alternatively, both valves 58 may be open or both may be closed, in which case the motor 52 is inoperative. By controlling the valves, using data signals from appropriate sensors, the motor 52 can be operated to hold the bent housing in a desired location or orientation.

Although the description herein uses the motor and associated control arrangement to adjust the orientation of a bent housing to achieve steerable drilling control, it will be appreciated that it could be used in a number of other applications. For example, it could be used to control the position of a collar attached to a milling tool used to cut a slot in a casing, thereby controlling the cutting direction. Alternatively, it could be used to control any other component which needs to be moved to a specific angular position relative to the formation, for example part of a rotary valve, a hole finding device, a perforating gun, a fishing tool, a whipstock or a formation sampling tool. Other applications including controlling the position of a component which needs to be isolated from the rotation of the drill string or collar in order to operate properly to control the position of a sensor platform or collar section to allow sensors provided hereon to take downhole measurements, for example to provide azimuthal control for a directional gamma sensor.

A number of other modifications and alterations are possible without departing from the scope of the invention.

The invention claimed is:

1. A steerable drilling system, comprising:

a drill string carrying a bent housing, the bent housing containing or having associated therewith a drive motor arranged to drive a drive shaft angled to an axis of part of the drill string adjacent the bent housing; and;

an orienting motor carried by one of the drill string and the bent housing, the orienting motor having an output shaft connected to the other of the drill string and the bent housing, the orienting motor being operable to drive the output shaft in a reverse direction relative to a direction of rotation of the drill string, the orienting motor rotating the output shaft at the same rotational speed of the drill string but in an opposite direction while the drill string is rotated, thus forming a curve in a borehole being formed, wherein the orienting motor controls the angular position of the bent housing relative to the drill string.

2. The system according to claim 1, wherein the orienting motor is located in a separate housing located between and secured to one of the drill string and the bent housing.

3. The system according to claim 1 further comprising a releasable latch arrangement.

4. The system according to claim 1 wherein the orienting motor has at least one anchor associated therewith to allow the orienting motor to be anchored against rotation whilst being operable to drive the bent housing to the desired orientation.

5. The system according to claim 4, wherein the anchor allows axial movement of the orienting motor.

6. The system according to claim 1, wherein the rotation of the drill string is used to orient the bent housing, an anchor arrangement being provided to resist rotation of the bent housing when the desired orientation is achieved, a latch being released to allow rotation of the drill string to continue.

7. The system according to claim 1 wherein the orienting motor comprises a mud or drilling fluid driven motor.

8. The system according to claim 7, further comprising a control valve arrangement to control the supply of fluid to the motor.

9. The system according to claim 8, wherein the control valve arrangement controls the supply of fluid to both ends of the motor and thereby controls its direction of rotation.

10. The system according to claim 8 wherein the control valve arrangement comprises a rotary valve including one plate component rotatable with a rotor of the motor, and another plate component the angular position of which is controlled by a control unit.

11. The system according to claim 10, wherein the said another plate component is connected to a roll stabilized platform.

12. The system according to claim 8 wherein the valve arrangement comprises a pair of bistable valves, each controlling the supply of fluid to a respective end of the motor.

13. The system according to claim 1 wherein the orienting motor is an electrically powered motor.

14. The system according to claim 13, further comprising electrical generator means to supply electrical power to the orienting motor.

15. The system as claimed in claim 1 wherein the motors output is transmitted via a gearbox.

16. The system according to claim 1, wherein a releasable latch arrangement and an anchor are provided, a control arrangement being provided to ensure that only one of the latch arrangement and the anchor is operative at any given time.

17. The system according to claim 1, wherein a releasable latch is provided, the releasable latch comprising a pair of engageable friction surfaces.

18. The system according to claim 1, wherein a releasable latch is provided, the releasable latch comprising an electro dynamic, hydraulic or magneto rheological fluid braking arrangement.

19. The system according to claim 1 wherein an anchor is provided, the anchor including at least one anchor rib movable by a hydraulic drive or by a piston.

20. A steerable drilling system, comprising:

a drill string carrying a bent housing, the bent housing containing or having associated therewith a drive motor arranged to drive a drive shaft angled to an axis of part of the drill string adjacent the bent housing, an orienting motor carried by one of the drill string and the bent housing, the orienting motor having an output shaft connected to the other of the drill string and the bent housing, the orienting motor being operable to drive the output shaft in a reverse direction relative to a direction of rotation of the drill string to form a curve in a borehole being formed; and an anchor mounted on the bent housing, the anchor being selectively actuated to anchor the bent housing against angular movement relative to a surrounding formation, wherein the drill string continues to rotate when the bent housing is held against angular movement.

21. The steerable drilling system as claimed in claim 20, wherein relative rotation of the bent housing allows the drill string to continue to rotate when the bent housing is held against rotation.

* * * * *